US005313184A

United States Patent [19]

Greuter et al.

[11] Patent Number: 5,313,184

[45] Date of Patent: May 17, 1994

[54] RESISTOR WITH PTC BEHAVIOR

[75] Inventors: Felix Greuter, Baden-Rütihof; Claus Schüler, Widen; Ralf Strümpler, Baden, all of Switzerland

[73] Assignee: Asea Brown Boveri Ltd., Baden, Switzerland

[21] Appl. No.: 989,555

[22] Filed: Dec. 11, 1992

[30] Foreign Application Priority Data

Dec. 21, 1991 [DE] Fed. Rep. of Germany ..... 4142523

[51] Int. Cl.[5] ..... H01C 7/10

[52] U.S. Cl. ..... 338/21; 338/22 R; 338/204; 338/14; 338/24; 338/22.5 D

[58] Field of Search ..... 338/21, 20, 22 R, 225 D, 338/204, 205, 207, 320, 14, 23, 24; 361/13, 16, 56, 57, 103

[56] References Cited

U.S. PATENT DOCUMENTS

| | | | |
|---|---|---|---|
| 3,795,048 | 3/1974 | Tachibana et al. | 29/621 |
| 3,805,022 | 4/1974 | Kulwicki et al. | 338/21 X |
| 4,152,743 | 5/1979 | Comstock | 361/56 |
| 4,271,446 | 6/1981 | Comstock | 361/56 |
| 4,347,539 | 8/1982 | Peterson et al. | 361/16 |
| 4,534,889 | 8/1985 | van Konynenburg et al. . | |
| 4,583,146 | 4/1986 | Howell | 361/13 |
| 4,780,598 | 10/1988 | Fahey et al. | 361/57 |
| 5,008,646 | 4/1991 | Hennings et al. . | |
| 5,064,997 | 12/1991 | Fang et al. | 338/22 R X |

FOREIGN PATENT DOCUMENTS

| | | |
|---|---|---|
| 851087 | 7/1952 | Fed. Rep. of Germany . |
| 1143259 | 2/1963 | Fed. Rep. of Germany . |
| 1465439 | 7/1973 | Fed. Rep. of Germany . |
| 2510322 | 8/1976 | Fed. Rep. of Germany . |
| 2853134 | 7/1983 | Fed. Rep. of Germany . |
| 3231066 | 2/1984 | Fed. Rep. of Germany . |
| 3231781 | 3/1984 | Fed. Rep. of Germany . |
| 3544141 | 6/1986 | Fed. Rep. of Germany . |
| 2948350 | 2/1990 | Fed. Rep. of Germany . |

OTHER PUBLICATIONS

"New, Z-direction anisotropically conductive composites", Jin, et al., J. Appl. Phys. 64 (10), Nov. 15, 1988, pp. 6008-6010.

"Composite PTCR thermistors utilizing conducting borides, silicides, and carbide powders", Shrout, et al., Journal of Materials Science 26 (1991), pp. 145-154.

*Primary Examiner*—Marvin M. Lateef

*Attorney, Agent, or Firm*—Burns, Doane, Swecker & Mathis

[57] ABSTRACT

An electric resistor has a resistor body arranged between two contract terminals. This resistor core includes an element with PTC behavior which, below a material-specific temperature, forms an electrically conducting path running between the two contact terminals. The resistor can be simple and inexpensive, but still have a high rate current-carrying capacity protected against local and overall overvoltages. This is achieved by the resistor core additionally containing a material having varistor behavior. The varistor material is connected in parallel with at least one subsection of the electrically conducting path, forming at least one varistor, and is brought into intimate electrical contact with the part of the PTC material forming the at least one subsection. The parallel connection of the element with PTC behavior and the varistor can be realized both by a microscopic construction and by a macroscopic arrangement.

17 Claims, 1 Drawing Sheet

RESISTOR WITH PTC BEHAVIOR

BACKGROUND OF THE INVENTION

1. Field of the Invention

The invention is based on an electric resistor having a resistor core which is arranged between two contact terminals and contains a material which has a PTC behaviour and, below a material-specific temperature, forms at least one electrically conducting path running between the two contact terminals.

2. Discussion of Background

A resistor of the type mentioned above has long been state of the art and is described, for example, in DE 2 948 350 C2 or U.S. Pat. No. 4,534,889 A. Such a resistor contains a resistor core made of a ceramic or polymeric material which exhibits PTC behavior and, below a material-specific limiting temperature, conducts electric current well. PTC material is, for example, a ceramic based on doped barium titanate or an electrically conductive polymer, for instance a thermoplastic, semicrystalline polymer, such as polyethylene, with for example carbon black as conductive filler. If the limiting temperature is exceeded, the resistivity of the resistor based on a PTC material increases abruptly by many orders of magnitude.

Therefore, PTC resistors can be used as an overload protection for circuits. On account of their restricted conductivity, carbon-filled polymers, for example, have a resistivity greater than 1 Ωcm, they are generally restricted in their practical application to rated currents up to about 8 A at 30 V and up to about 0.2 A at 250 V.

Specified in J. Mat. Sci. 26(1991) 145 et seq. are PTC resistors based on a polymer filled with borides, silicides or carbides having a very high conductivity at room temperature which are said to be useable as current-limiting elements even in power circuits with currents of, for example, 50 to 100 A at 250 V. However, such resistors are not commercially available and therefore cannot be realized without considerable expenditure.

In the case of all PTC resistors, the thickness of the resistance material between the contact terminals, together with the dielectric strength of this material, determines the magnitude of the voltage held by the resistor in the high-impedance state. In the case of a rapid transition from the low-impedance state to the high-impedance state, however, larger overvoltages are induced—in particular in the case of circuits with high inductance. These overvoltages can only be effectively reduced if the PTC resistor is given large dimensions. This inevitably leads either to a considerable reduction in its current-carrying capacity or to an unacceptably large component. In addition, it may happen that, in the case of overloading at locally predetermined points, such as for instance in the center between the contact terminals—the PTC resistor becomes hotter than at other locations and consequently switches into the high-impedance state earlier at these points than at the non-heated locations. Then the entire voltage applied across the PTC resistor drops over a relatively small distance at the location of the highest resistance. The associated high electric field strength may then lead to disruptive discharges and to damage of the PTC resistor.

SUMMARY OF THE INVENTION

Accordingly, one object of the invention, as specified in patent claim 1, is to provide a novel resistor with PTC behavior which is simple and inexpensive and is nevertheless distinguished by high rated current-carrying capacity and high dielectric strength.

The resistor according to the invention comprises commercially available elements, such as at least one varistor based on AnO, $SrTiO_3$, SiC or $BaTiO_3$, and at least one element made of PTC material, and is of a simple construction. Therefore, it can not only be produced comparatively inexpensively, but can at the same time also be given small dimensions. This is due to the fact that the overvoltages induced by a turning-off operation of the resistor according to the invention are discharged by the varistor, and therefore the PTC element inducing the overvoltages has to be designed only for the breakdown voltage of the varistor.

In addition, locally occurring overvoltages are discharged by the varistor. In this case, it is of particular advantage that, on account of the intimate contacting of varistor and PTC material, the varistor has a lower breakdown voltage over small distances than over its complete length.

In addition, the relatively high thermal conductivity of the ceramic located in the varistor ensures a homogenization of the temperature distribution in the resistor according to the invention. As a result, the risk of local overheating is effectively countered and the rated current-carrying capacity is increased quite substantially in spite of small dimensioning.

Preferred illustrative embodiments of the invention and the further advantages which can be achieved by them are explained in more detail below with reference to drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
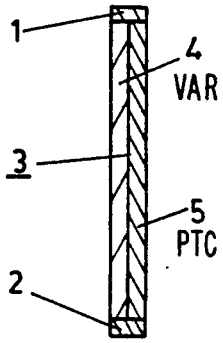
FIGS. 1 to 7 in each case show a plan view of a section through one each of seven preferred illustrative embodiments of the resistor with PTC behavior according to the invention.
Figure 2:
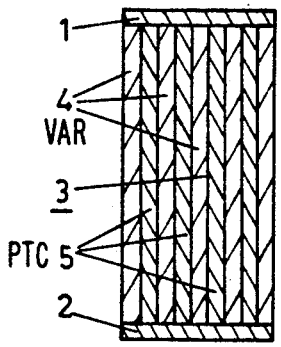

Referring now to the drawings, wherein like reference numerals designate identical or corresponding parts throughout the several views, the resistors represented in FIGS. 1 to 7 in each case contain a resistor core 3 which is arranged between two contact terminals 1, 2. In the case of the illustrative embodiments according to FIGS. 1 and 2, the resistor core 3 is constructed from two or more sheet-like elements, preferably designed as a board in each case. One of these elements is a varistor 4, which is preferably formed from a ceramic based on a metal oxide, such as for instance ZnO, or a titanate, such as for instance $SrTiO_3$ or $BaTiO_3$, or a carbide, such as for instance SiC. The varistor 4 is contacted with both terminals 1, 2 and has a breakdown voltage which lies above the rated voltage of the electric system in which the resistor is used. The other element 5 of the two elements consists of PTC material and may be formed by a thermoplastic or thermoset polymer or else by a ceramic. In a way corresponding to the varistor 4, the PTC element 5 is also contacted with both terminals 1, 2. Varistor 4 and PTC element 5 have a common bearing surface over their entire sheet-like extent. At this bearing surface, both elements are brought into intimate electrical contact with each other.

These resistors are preferably produced as follows: first of all about 0.5 to 2 mm thick boards are produced from a varistor ceramic by a process customary in varistor technology, such as for instance by pressing or casting and subsequent sintering. Using a shearing mixer, PTC material based on a polymer is produced from epoxy resin and an electrically conductive filler, such as for example TiC. This material is poured with a thickness of 0.5 to 4 mm onto a previously produced varistor ceramic in board form. If appropriate, it is possible to cover the poured-on layer with a further varistor ceramic and successively repeat the process steps described above. This results in a stack in which, in a manner corresponding to a multilayer arrangement, alternately succeeding layers of varistor and PTC material are arranged. The epoxy resin is then cured at temperatures between 60° and 140° C., forming the resistor core 3.

Instead of a thermoset PTC polymer, a thermoplastic PTC polymer may also be used. This is first of all extruded to give thin boards or sheets, which after assembly with the varistor ceramic in board form are subsequently hot-pressed to form the resistor core 3.

If the PTC material used is a ceramic, the sheet-like elements 4, 5 made of varistor and PTC ceramic may be bonded to each other by adhesion by means of an electrically anisotropically conducting elastomer. For the purpose of forming the intimate electric contact between the different ceramics, this elastomer should have a high adhesive strength. In addition, this elastomer should be electrically conducting only in the direction of the normal to the sheet-like elements. Such an elastomer is known, for example, from J. Applied Physics 64(1984) 6008.

The resistor cores 3 may subsequently be divided up by cutting. The resistor cores produced in this way may have, for example, a length of 0.5 to 20 cm and end faces of, for example, 0.5 to 10 $cm^2$. The end faces of the resistor cores 3 of sandwich structure are smoothed, for instance by lapping and polishing, and may be bonded to the contact terminals 1, 2 by soldering on with a low-melting solder or by sticking on with a conductive adhesive.

The resistor according to the invention normally conducts current during the operation of a system accommodating it. The current in this case flows in an electrically conducting path of the PTC element 5 running between the contact terminals 1 and 2. If, on account of an overcurrent, the PTC element 5 heats up so intensely that the PTC element abruptly increases its resistance by many orders of magnitude, the overcurrent is abruptly interrupted and in this way an overvoltage is induced in the PTC element 5. The varistor 4 is connected in parallel over its complete length with the entire PTC element 5 and consequently also with the current path of the latter carrying the overcurrent. As soon as the overvoltage exceeds the breakdown voltage of the varistor 4, the overcurrent is discharged in parallel through the varistor 4, and thus the overvoltage is limited. Therefore, the PTC element 5 has to be designed only for the breakdown voltage of the varistor 4. Locally occurring overvoltages are likewise discharged via the varistor 4, which has a corresponding reduced breakdown voltage over small distances. The comparatively high thermal conductivity of the varistor ceramic at the same time ensures a homogenization of the temperature distribution in the PTC element 5, as a result of which local overheating effects are avoided in this element. In addition, the high heat dissipation into the varistor contributes to increasing considerably the nominal current-carrying capacity of the resistor according to the invention in comparison with a PTC resistor according to the prior art.

Figure 3:
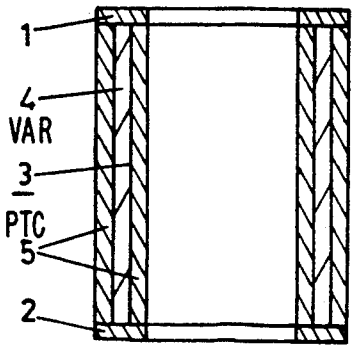

In FIG. 3, a resistor according to the invention which is tubularly shaped and slit along its tube axis is represented. This resistor contains a varistor 4 and two PTC elements 5. The varistor 4 and the PTC elements are in each case hollow cylinders and, together with annular contact terminals, form a tubular resistor. This resistor may be produced to advantage from a hollow-cylindrical varistor ceramic which is coated in a cylindrical casting mold on the inner surface and outer surface with a polymeric PTC casting compound, for instance based on an epoxy resin. Instead of a hollow-cylindrical varistor ceramic, a solid-cylindrical varistor ceramic may also be used. A resistor fitted with such a varistor is particularly simple to produce, whereas a resistor designed as a tube has a particularly good thermal conduction by convection and can be cooled particularly well by a fluid. If, instead of a thermoset polymer, a thermoplastic polymer is used as PTC material, the PTC material may be extruded directly onto the cylinder or the hollow cylinder.

Figure 4:
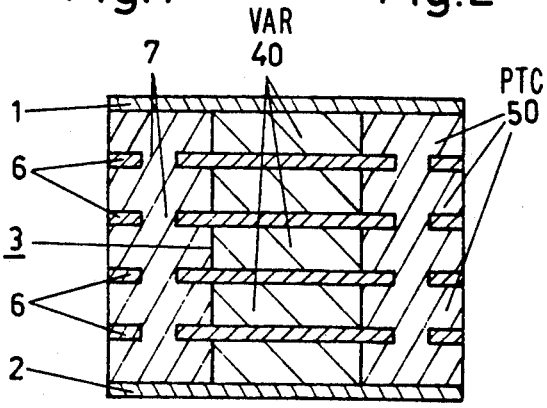
Figure 5:
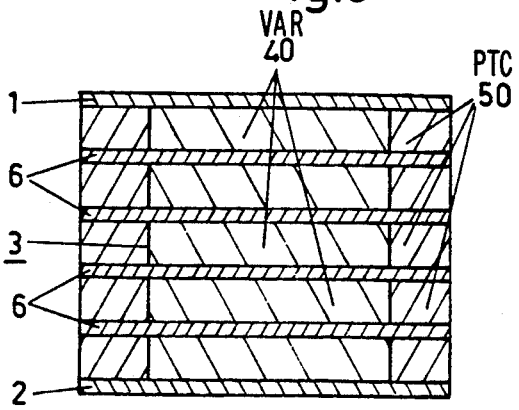
Figure 6:
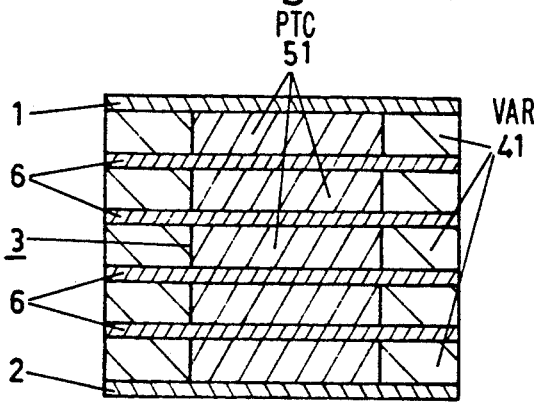

In the case of the embodiments according to FIGS. 4 to 6, the resistor core 3 has in each case the form of the solid cylinder with varistors and PTC elements stacked one on top of the other. The varistors are designed as circular disks 40 or as tori 41, and the PTC elements in a congruent manner as tori 50 or as circular disks 51. In contrast to the embodiments according to FIGS. 1 to 3, contact disks 6 are additionally provided. Each varistor, designed as disk 40 or torus 41, is in intimate electric contact along its complete circumference with a PTC element 5, designed as torus 50 or disk 51. Each varistor and each PTC element 5 contacted with it is either contacted with one of the two contact terminals 1, 2 and a contact disk 6 or with two contact disks 6. The varistors or the PTC elements are thus connected in series between the contact terminals 1, 2 in the case of each of the embodiments 4 to 6.

The resistors according to FIGS. 4 to 6 may be produced as follows: The disks 40 and tori 41 used as varistor 4 may be produced from powdered varistor material, such as for instance from suitable metal oxides, by pressing and sintering. The diameters of the disks may lie, for example, between 0.5 and 5 cm and those of the tori between 1 and 10 cm in the case of a thickness of, for example, between 0.1 and 1 cm. The varistors 4 designed as disks 40 are stacked one on top of the other with the contact disks 6 lying in between. The contact disks 6 may in this case have holes 7 of any desired shape in the marginal region and, if appropriate, may even be designed as grids. The stack is introduced into a casting mold. The space between the contact disks 6 which is still free is then filled with polymeric PTC material, forming the tori 50, and the cast stack is cured. Upper side and underside of the stack are subsequently contacted.

In the case of a resistor produced in this way, the metal contact disks 6 ensure a low transition resistance in a current path formed by the disks 40 or tori 50, respectively connected in series. Overvoltages occurring can be discharged via the complete circular crosssection of the disks 40. Due to the holes 7 filled with PTC material, the overall resistance in the current path of the PTC elements designed as tori 50 is reduced. Local overvoltages in instances of overheating in the resistor are avoided particularly well in the case of this embodiment, since the resistor is subdivided by the contact disks 6 into subsections, and since a varistor, designed as disk 40, is connected in each subsection in parallel with a PTC element, designed as torus 50, and consequently in parallel with a subsection of the current path inducing the local overvoltages.

The PTC tori 50 may also be sintered from ceramic. Then there is no need to punch holes in the contact disks 6. The contact resistance can in this case be kept small by pressing or soldering.

As can be seen from the embodiment according to FIG. 6, the varistors may be designed as tori 41 and the PTC elements as circular disks 51. In order to achieve a low overall resistance in the case of this embodiment with the use of a polymeric PTC material, it is recommendable to provide the holes 7 in a central region of the contact disks 6.

Figure 7:
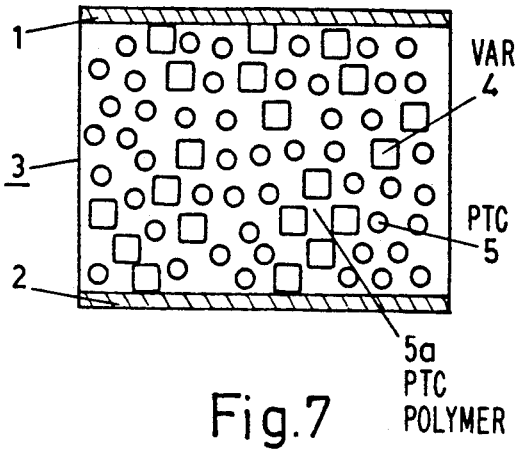

In the case of the embodiment according to FIG. 7, the varistors 4 are built into the PTC element 5. Such an embodiment of the resistor according to the invention can be achieved by admixing in a PTC polymer 5 not only an electrically conductive component, such as for example C, $TiB_2$, TiC, $WSi_2$ or $MoSi_2$, but also an adequate amount, for example 5 to 30 percent by volume, of varistor material in powder form. The particle size and the breakdown voltage of the added varistor material, marked by squares in FIG. 7, can be adjusted over a large range and is matched to the particle size of the conductive filler of the PTC element 5, in FIG. 7. The varistor material may be produced, for example, by sintering of spray granules, as occurs as a substep in varistor manufacture. The particle diameters typically lie between 5 and several hundred $\mu$m. The breakdown voltage of an individual varistor particle can in this case be varied between 6 V and several hundred volts. The shaping of the composite to form the resistor core 3 may be performed by hot pressing or by casting with subsequent curing at elevated temperature. Subsequent attachment of the contact terminals 1, 2 to the resistor core 3 finally results in the resistor.

In normal operation of the resistor, the conducting filler forms current paths passing through the resistor core and at the same time brings about the PTC effect. The varistor material, on the other hand, forms, depending on the added amount, paths which percolate locally or through the entire resistor core 3 and can discharge overvoltage.

A composite structure may also be produced by mixing sintered or ground granular particles of a PTC ceramic with ceramic varistor particles. The mutual bonding and electric contacting can in this case be ensured by a metallic solder. The proportion by volume of this solder must lie below the percolation limit, since only in this way are the PTC behavior and the varistor behavior of the resistor simultaneously ensured.

Obviously, numerous modifications and variations of the present invention are possible in light of the above teaching. It is therefore to be understood that, within the scope of the appended claims, the invention may be practiced otherwise than as specifically described herein.

What is claimed as new and desired to be secured by letters patent of the United States is:

1. An electric resistor comprising: a resistor core which is arranged between two contact terminals and including a material which has PTC behavior and, below a material-specific temperature, forms at least one electrically conducting path running between the two contact terminals, wherein the resistor core additionally includes a material having varistor behavior, and wherein the varistor material is electrically connected in parallel with at least one subsection of the at least one electrically conductive path, forming at least one varistor, and is brought into intimate electric contact with the part of the PTC material forming the at least one subsection.

2. The resistor as claimed in claim 1, wherein the at least one varistor is contacted with both contact terminals.

3. The resistor as claimed in claim 2, wherein the at least one varistor and any additional varistors include a sheet-like layer of varistor material, wherein the PTC material is formed by one or more sheet-like layers, and wherein layers of varistor material and PTC material are arranged alternately in succession as a stack.

4. The resistor as claimed in claim 2, wherein the at least one varistor and any additional varistors provided as well as the PTC material are each formed as hollow cylinders or as solid cylinders, and wherein the at least one varistor and at least one element of PTC material are arranged alternately in succession, forming a tube or a solid cylinder.

5. The resistor as claimed in claim 3, wherein the PTC material is a polymer which is produced by pouring onto a neighboring varistor, forming the intimate electric contacts, and subsequent curing or by laying as a board-like or sheet-like element onto a neighboring varistor and subsequent hot-pressing.

6. The resistor as claimed in claim 3, wherein the PTC material is a ceramic which is fastened by means of an electrically anisotropically conducting material, such as in particular an elastomer, on a neighboring varistor, forming the intimate electric contact.

7. The resistor as claimed in claim 1, wherein a first varistor is contacted with a first terminal of the two contact terminals and a contact disk and a second varistor is contacted either with two contact disks or one contact disk and a second terminal of the two contact terminals.

8. The resistor as claimed in claim 7, wherein the first and second varistor are a circular disk, and wherein these disks are in each case surrounded by a torus formed from PTC material.

9. The resistor as claimed in claim 7, wherein the first and the second varistor are tori, and wherein these tori in each case surround a circular disk formed from the PTC material.

10. The resistor as claimed in claim 9, wherein the contact disks have holes which are filled with PTC material and by which the disks including the PTC material are connected to one another.

11. The resistor as claimed in claim 10, wherein the PTC material includes a thermoset or thermoplastic polymer which, after creating a stack containing the contact disks and the first and second varistor, is cast or hot-pressed into the stack, forming the disks.

12. The resistor as claimed in claim 8, wherein the tori of PTC material are made of ceramic.

13. The resistor as claimed in claim 1, wherein the at least one varistor is arranged in particle form in the resistor core and, with further varistors provided in particle form in the resistor core, forms current paths which percolate locally or completely through the resistor core after reaching the breakdown voltage dependent on the particle size and material composition.

14. The resistor as claimed in claim 8, wherein the contact disks have holes which are filled with PTC material and by which the tori including the PTC material are connected to one another.

15. The resistor as claimed in claim 14, wherein the PTC material includes a thermoset or thermoplastic polymer which, after creating a stack containing the contact disks and the first and second varistor, is cast or hot-pressed into the stack, forming the tori.

16. The resistor as claimed in claim 9, wherein the disks of PTC material are made of ceramic.

17. The resistor as claimed in claim 4, wherein the PTC material is a polymer which is produced by pouring onto a neighboring varistor, forming the intimate electric contacts, and subsequent curing or by laying as a board-like or sheet-like element onto a neighboring varistor and subsequent hot-pressing.

* * * * *